US006204814B1

(12) United States Patent
Rothe

(10) Patent No.: US 6,204,814 B1
(45) Date of Patent: Mar. 20, 2001

(54) PLANAR EMITTER

(76) Inventor: Lutz Rothe, Am Muhlberg 43, D-06132, Halle (DE)

( * ) Notice: Subject to any disclaimer, the term of this patent is extended or adjusted under 35 U.S.C. 154(b) by 0 days.

(21) Appl. No.: 09/142,679

(22) PCT Filed: Mar. 13, 1997

(86) PCT No.: PCT/EP97/01275

§ 371 Date: Nov. 27, 1998

§ 102(e) Date: Nov. 27, 1998

(87) PCT Pub. No.: WO97/35355

PCT Pub. Date: Sep. 25, 1997

(30) Foreign Application Priority Data

Mar. 16, 1996 (DE) ..... 196 15 497

(51) Int. Cl.[7] ..... H01Q 1/38
(52) U.S. Cl. ..... 343/700 MS; 343/846
(58) Field of Search ..... 343/700 MS, 846, 343/829, 830; H01Q 1/38

(56) References Cited

U.S. PATENT DOCUMENTS

| | | | | |
|---|---|---|---|---|
| 4,318,107 | | 3/1982 | Pierrot et al. | 343/700 MS |
| 4,899,164 | * | 2/1990 | McGrath | 343/700 MS |
| 4,973,972 | | 11/1990 | Huang | 343/700 MS |
| 5,001,493 | * | 3/1991 | Patin et al. | 343/700 MS |
| 5,227,749 | * | 7/1993 | Raguenet et al. | 343/700 MS |
| 5,315,753 | * | 5/1994 | Jensen et al. | 343/700 MS |
| 5,382,959 | * | 1/1995 | Pett et al. | 343/700 MS |
| 5,510,803 | * | 4/1996 | Ishizaka et al. | 343/700 MS |
| 5,554,995 | * | 9/1996 | Jun | 343/700 MS |
| 5,859,614 | * | 1/1999 | Paolella et al. | 343/700 MS |

FOREIGN PATENT DOCUMENTS

| | | |
|---|---|---|
| 43 06 056 | 9/1993 | (DE) . |
| 43 40 825 | 6/1995 | (DE) . |
| 0 200 819 | 11/1986 | (EP) . |

* cited by examiner

*Primary Examiner*—Hoanganh Le
(74) *Attorney, Agent, or Firm*—Woodbridge & Associates, P.C.; Richard C. Woodbridge

(57) ABSTRACT

A planar emitter equipped with planar resonators that is simple, small in construction and consists of few, easily manufactural components, while at the same time having high frequency dependent system quality with the widest possible spectral range, has a plurality of sandwich-like layers (4, 5, 6, 7, 8) that are planned parallel to each other with the layer (5) being made of two different dielectric materials (14) and (15). The thickness (L1) of layer (14) is greater than the thickness (L2) of layer (15) with layer (4) having a plurality of spaced, thin layer, electrically conductive planar resonators (4) in contact with one side of layer (15). One side of layer (14) is in contact with an electrically conductive thin layer (6) that defines a common earthing member that has its opposite side in contact with layer (17) made of a dielectric material. A coupling network (3) is included in layer (8) and comprises microstrip circuits (3*a*–3*f*) in contact with layer (7). Means in the form of pins (9) extends through the layers (5, 6, 7) from said coupling network (3) to said planar resonators (4) to couple said planar resonators (4) electrically in phase.

18 Claims, 6 Drawing Sheets

PLANAR EMITTER

BACKGROUND OF THE INVENTION

1. Field of the Invention

The invention concerns a planar emitter with an emitter plane equipped with planar resonators and a network plane equipped with a coupling network whereby the planar resonators are coupled with one another in-phase and galvanically via the coupling network.

2. Description of Related Art

Reflector antennas or planar antennas or planar emitters are used for communications services, particularly multi-point, multi-channel communications services, that require reception or emission of directed electromagnetic emission fields of linear polarization in the microwave spectrum. The emitter characteristics of the reflector antennas are based on the production of an appropriate amplitude and phase relationship of the electromagnetic emission field components on the reflector surface by means of suitable exciters. The reflectors used in this case are either in the form of closed surfaces of defined curvature and envelope or are laid out using gridlike arrangements of discrete conductive linear elements of defined length and spacing. Conventional planar solutions are based on the arrangement of galvanically and parallel fed planar resonators of defined group size and spacing of each one.

A planar array-antenna in strip-conductor technology is described in ES 0 200 819. The mechanical construction consists of a first substrate plate as the carrier for antenna elements and a second substrate plate as carrier for the coupler and signal processing. Both substrate plates are connected to each other via a thick metal plate whereby the thickness of the metal plate corresponds to the half of the operational wave length. The electrical connection between the antenna elements on the front of the antenna and the couplers on the back of the antenna produce coaxial conductors that are insulated and are passed through the passages in the metal plate.

A planar antenna is described in ES 0 383 292 in which the antenna elements are glued to the earthing surface of a double-layered circuit board on which the coupling network and the additional electronics are situated. The antenna element consists of a planar resonator plate which is mounted on a dielectric substrate layer. The substrate layer of the antenna element is made of "glass epoxy" which, however, because of its dielectric characteristics has a negative influence on both efficiency and bandwidth.

A planar antenna is described in WO 95/09455 which is similarly constructed in a sandwich-like manner and in which, for production reasons, the layers carrying the antenna consist of two layers of the same material, since the antenna elements are capacitative coupled.

A disadvantage found in the conventional planar antennas is that they all provide for the most part high system quality only in a small spectral range and consequently are suitable only with limitations for use for multi-point multi-channel communications services, since only relatively few frequency bands using a single antenna are transmissible because of the small bandwidth. Due to their construction some of the antennas described are very heavy or are made of very expensive materials in order to reduce their weight.

SUMMARY OF THE INVENTION

It is therefore the purpose of the invention to provide a planar emitter equipped with planar resonators that is simple, small in construction and consists of few, easily manufactured components while at the same time having high frequency dependent system quality with in the widest possible spectral range, in such a manner that it is suitable for a multi-channel point-to-point-transmission, especially in the frequency range between 2.500 GHz to 2.686 GHz.

This problem is, as described in the invention, solved by a planar emitter as described herein.

The planar emitter as described in the invention requires only a common earthing surface for the emitter and the network planes whereby the total height of the emitter as compared to conventional planar emitters is clearly reduced and the manufacturing material costs are also reduced. Also, without affecting the characteristic wave impedance of the coupling network, the band width of the emission field transmitted and received by the emitter can be varied by the appropriate selection of the thickness of the first dielectric layer, whereby and at the same time high system quality over the entire spectral range is achieved. In a planar emitter it is necessary that the first layer is made of a material with the smallest possible dielectric constant ($r \rightarrow 1$). The two-layered construction of the first layer makes it possible to manufacture the thin layer carrying the resonator surfaces out of a heat-resistant material; for example, polyethylene terephtalate upon which the resonator surfaces can be permanently placed. The thicker layer or the first layer can be produced using an economical foam material. In order that the planar emitter is flexible or pliable the thickness of the thick layer is greater than the thickness of the thin layer. The thick layer consequently forms the actual foundation material of the planar emitter and determines by its r and the attenuation [lit. "loss"] angle tan essentially the characteristics of the emitter layer. The material of the thick layer is optimally the inexpensive material polystyrol which in its foam form is flexible and particularly has a specific weight volume of 20 $kg/m^3$. The thin layer is optimally formed using a polyethylene terephtalate film which is glued to the thick layer. The advantage of this polyethylene terephtalate film is that it engages copper in a strong and lasting bond whereby the resonator surfaces have a firm hold.

Each planar resonator is thus in electrically conductive connection, via an electrically conductive coupling pin, with the coupling network, whereby the electrically conductive coupling pin is installed in a drilled passage that is perpendicular to the emitter and network plane.

By the disproportionately large thickness of the first dielectric layer the coupling pins are relatively long, whereby the pins themselves have an electrically transforming effect. The inductive reaction components represented by the pin can therefore not be overlooked and must be compensated for. This can be done by means of a sheath that covers the pin at least sectionally and is made of a material, particularly Teflon, that has a higher dielectric number than that of the materials forming the dielectric layers serving at the basic material for the emitter and network planes. By means of the adjustment of the wall thickness, the height and the $\in_r$ of the sheath the capacitance per unit length of the pin-sheath-combination can be adjusted whereby the inductive reaction component of the pin is compensated.

On the other hand, the compensation of the inductive reaction component of the pin can be beneficially achieved by taking advantage of the transforming effect of the length and width proportions of the micro-strip circuits used. Such transformations using micro-strip circuits are quite adequate as shown in the respective literature. In this case, if necessary, the sheath can be dispensed with.

It is furthermore necessary that the electrically conductive thin layer in the areas where the electrically conductive pins pass through the layer, have circular fenestrated recesses, such that the pins are not in electrical connection with the electrically conductive layer. These circular fenestrated recesses form orifices, where the coupling coefficient is adjustable by using the diameter of the recesses. The coupling coefficient thereby determines the portion of signal intensity that is conducted from the emitter plane to the network plane. The optimal diameter of the apertures is obtained by simulation or experimental tests.

In order to make the planer emitter flexible or elastic there is the possibility that the first dielectric layer is constructed of two dielectric materials that each on its own part forms a layer. In this case, the thickness of the first layer is greater than the thickness of the second layer, whereby the second layer on its side remote from the first layer carries the resonator planes. The first layer thus forms the actual base material of the planar emitter and determines by its $\in_r$ and loss angel tan $\delta_\in$ essentially the characteristics of the emitter plane. The material of the first layer is optimally the inexpensive material polystyrol which in its foam form is flexible and in particular has a specific volume weight of 20 $kg/m^3$. The second layer is optimally formed using a polyethylenete rephthalate film which is glued to the first layer. The advantage of the polyethylenete rephthalate film is that it engages a firm and permanent connection with copper whereby the resonator planes have a firm hold.

An additional advantage achieved through the use of the sheaths discussed in the foregoing results from the fact that due to the rigidly constructed sheaths the gap between the emitter and the network planes, at least in the area of the pins, remains constant even under the effects of external forces when the antenna is installed. The system quality does not change even on bending and compression of the planar emitter.

The planar resonators can be formed and arranged as desired. In order to produce the necessary impedance profile to line of symmetry of the planar resonators lying diagonal to the emitting edge and for the production of the required emission related inherent characteristic of the planar resonators it is recommended that the planar resonators be constructed square, whereby the broad side is identical to the emitting edge. The planar resonators are thus arranged optimally matrix-wise to one another. In this case it has been demonstrated that it is sufficient for the majority of applications, if only eight planar resonators are arranged in two rows and four columns. Likewise, for reasons of simplified calculability and reduction of the dimensions of the planar emitter, it is advantageous if the row and column spacing of the arranged matrix-wise arrangement of the planar resonators is kept uniform.

In order to make possible satisfactory coupling out or coupling in of the signal received or emitted with the already available components and connector systems, the planar emitter has an extension that carries a wave path that connects a coupling point of the coupling network with a connector. A conventional N-bushing can be connected to the connector that is modified in such a way that the internal conductor of the bushing is connected to the micro-strip circuit that is situated on the extension of the dielectric carrier of the coupling network and that the earthing layer of the extension, that is simultaneously an extension of the electrically conductive layer, is connected with the external sleeve of the bushing surfacewise by the pressure produced by a dielectric pressure block. The wave path is formed by a micro-strip circuit, the second dielectric layer and the earthing layer that is correspondingly connected with the coaxial connector.

BRIEF DESCRIPTION OF THE DRAWINGS

In the following several design examples of the invention are presented in detail using drawings.

In the illustrations.

DETAILED DESCRIPTION OF THE INVENTION

Figure 1:
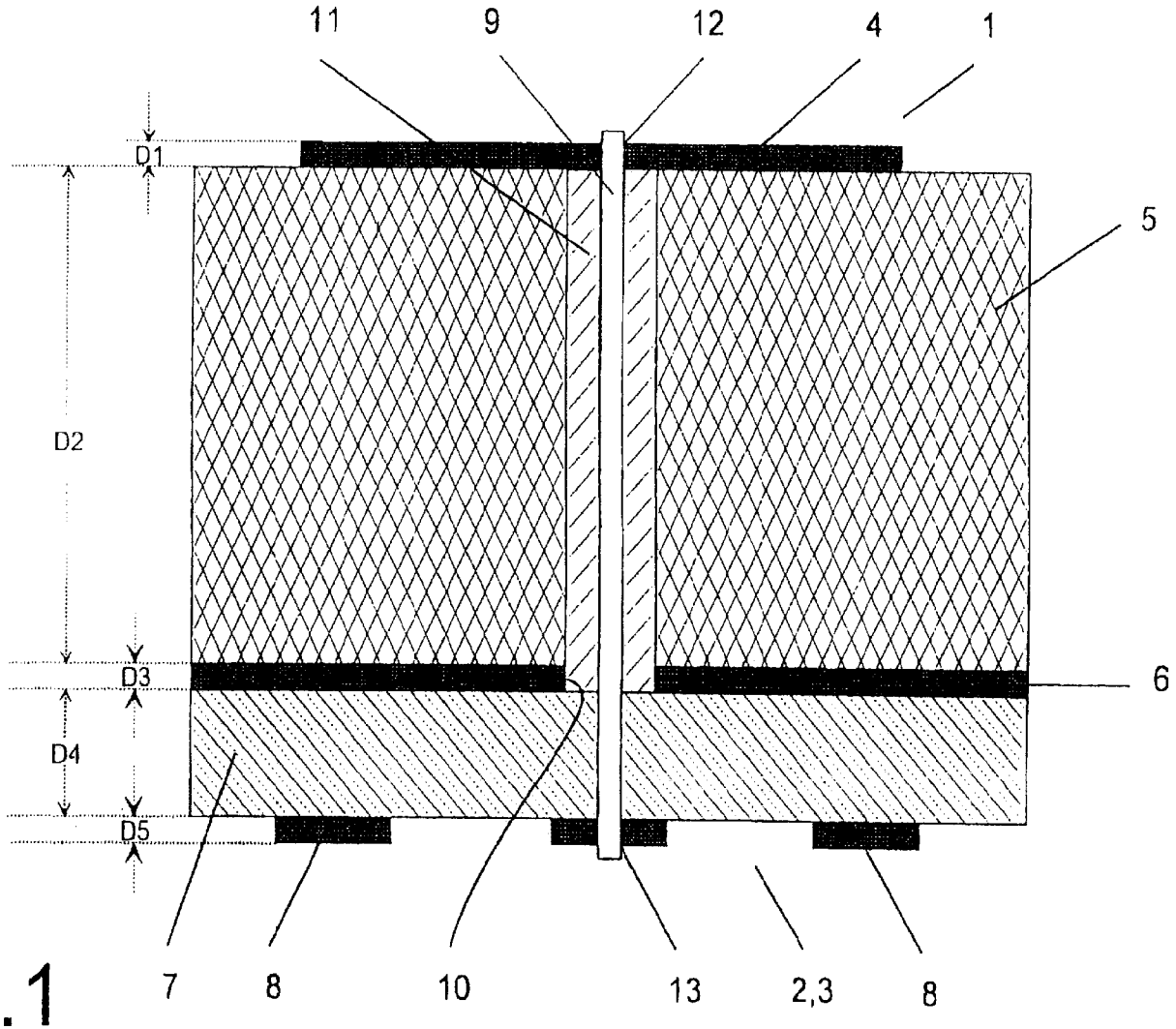
FIG. 1: A cross-sectional illustration of the planar emitter.

FIG. 1 illustrates a design form of the planar emitter as described in the invention in which the first dielectric layer (5) is made of a single material. On the top side of the layer (5) are the resonator planes (4) which are made up of a thin cooper layer. Between the first dielectric layer (5) and the second dielectric layer (7) there is the conductive earthing layer (6). The earthing layer (6) is an approximately 1718 um thick copper layer. On the flat side of the layer (7) remote to the earthing surface the micro-strip circuits (8) or the coupling network (3) are arranged. The coupling points (12) and (13) are contented using an electrically conductive pin (9). The pin (9) has a small cross sectional diameter so that the input impedance of the planar resonator (4) as determined by the position of the coupling point (12) does not become uncertain by a large-surface contact of the pin (9) with the resonator surface. The diameter of the pin (9) must therefore be selected to be small enough that the strip width of the coupling network (3) is not exceeded. The thickness of the pin (9) must therefore not exceed 1 mm. The pin is soldered in order to provide a secure set and improved permanent contact with the copper layers of the network and emitter planes and is surrounded by a sheath (11) that provides rigidity to the emitter.

The thickness (D2) of the layer (5) essentially determines the total height of the planar emitter.

The earthing layer (6) has, in those areas in which the pin (9) passes through the earthing layer (6), a circular recess (10) whose diameter is greater than the external diameter of the pin (9). If the length of the sheath (11) is equal to the lengths (D2) plus (D3), then the diameter of the recess (10) must at least be selected to be as large as the external diameter of the sheath (11).

The layer (5) is made of polysterol which is flexible in its foamed out form, whereby the planar emitter is flexible to a certain degree. This flexibility is impaired only minimally by the thin copper layers (4, 6 and 8) and the layer (7).

Figure 2:
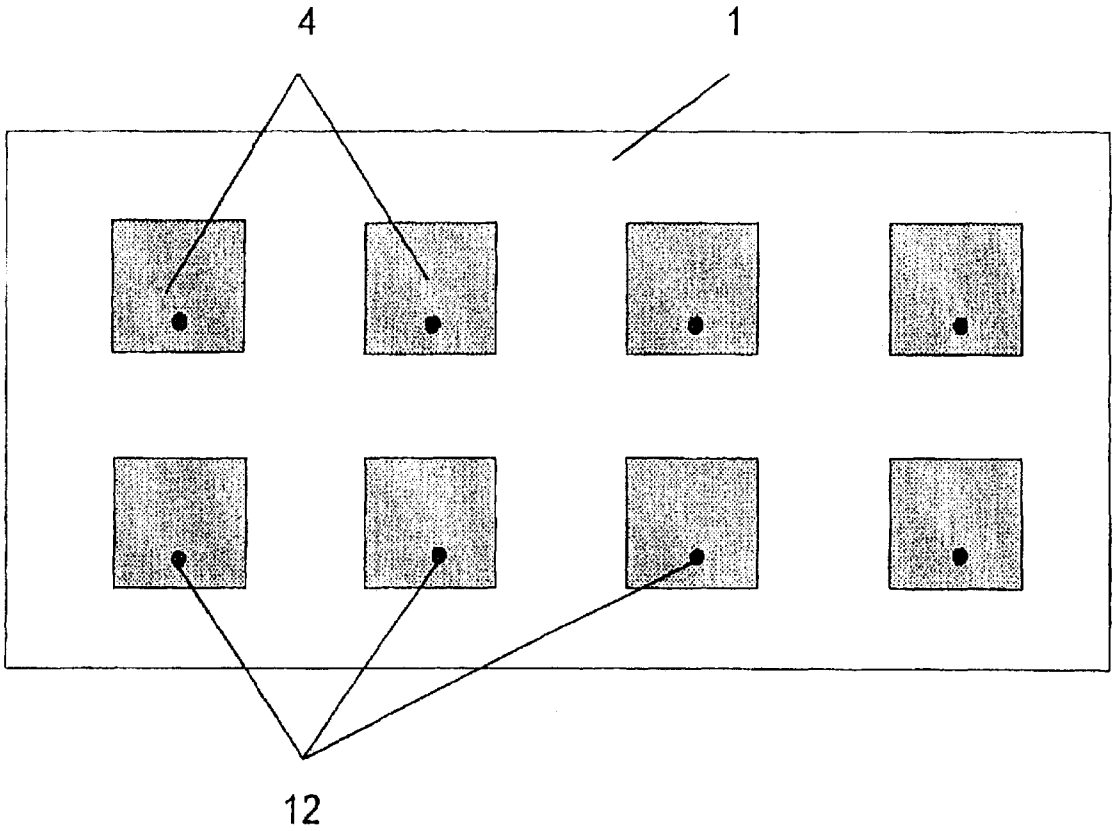
FIG. 2: A top view onto the emitter plane.

As can be seen in FIG. 2, the coupling point (12) must not be arranged centrically to the resonator plane. With the aid of conventional simulation methods, the required input impedance for the respective frequency and band width can be calculated, from which the location of the coupling point (12) can be deduced.

Figure 3:
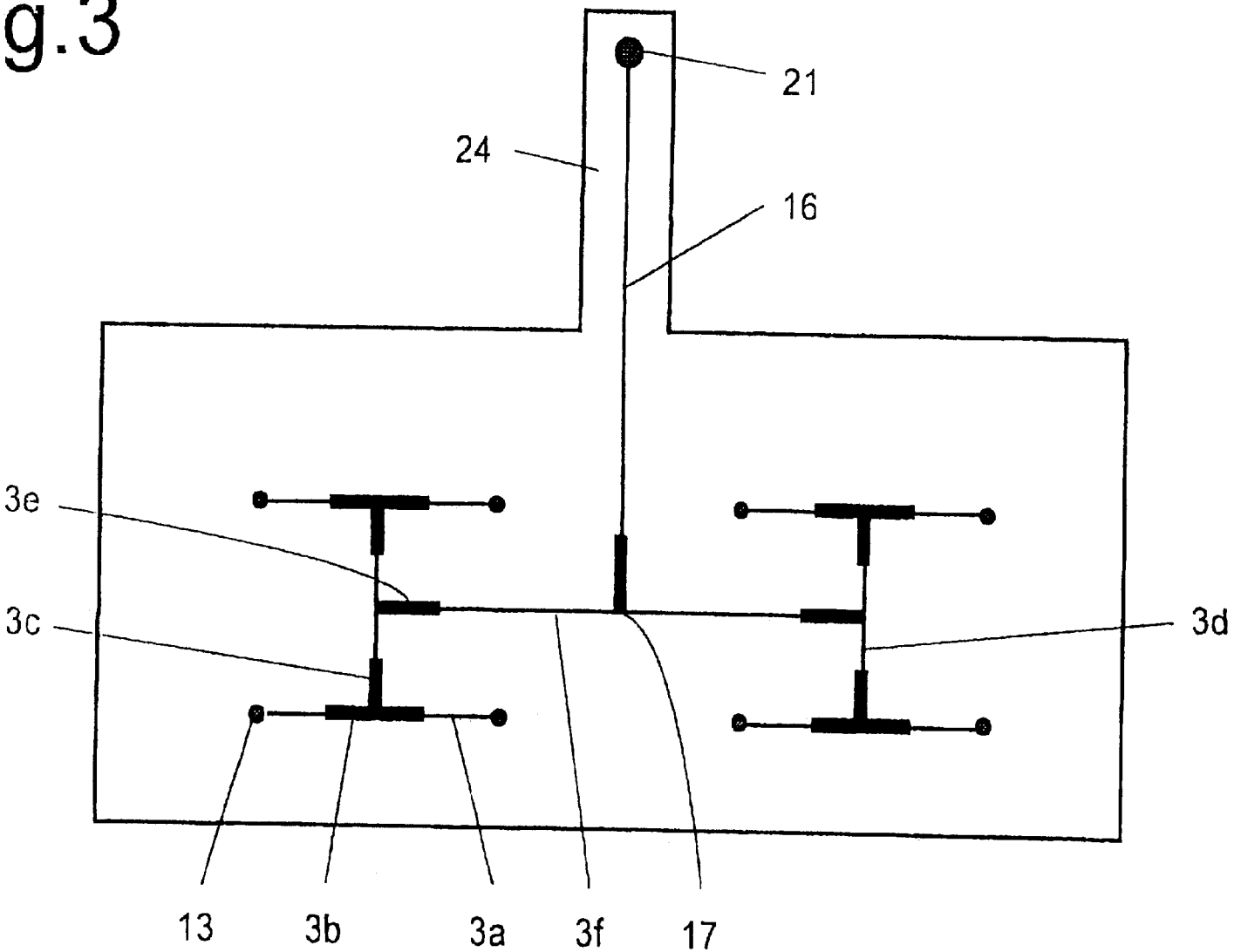
FIG. 3: A top view onto the network plane.

In FIG. 3 the coupling network (3) is shown together with the in- or out-coupled path (16) by the signal. The network (3) consists of strip circuits (3*a*3*f*) and (16). The strip conduction sectors have differing lengths and widths so that the inductive portion, that is caused by the length of the pin (9), is compensated, and to allow the impedance-adjusted convergence of the wave conduction paths leading to the planar resonators.

Figure 4:
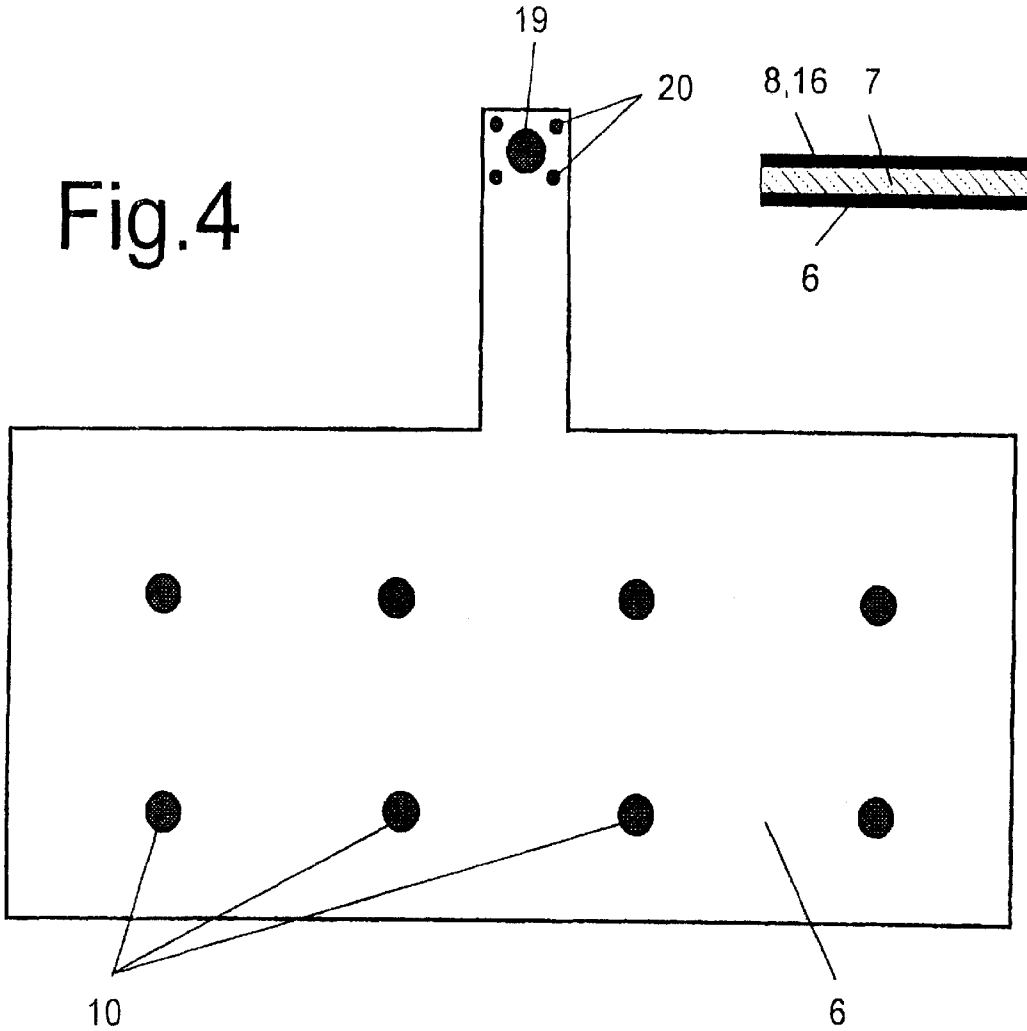
FIG. 4: A top view onto the electrically conductive earthing plane.

In FIG. 4 the conductive copper layer of the earthing layer (6) is illustrated. There the black points 10, 19, and 20 represent points, at which the copper has been gapped or recessed. Bore holes of the appropriate diameters are provided through those points so that pins (9) and (21), sleeves (11), and mounting screws for the connector (19) can pass through the earthing surface (6).

Figure 5:
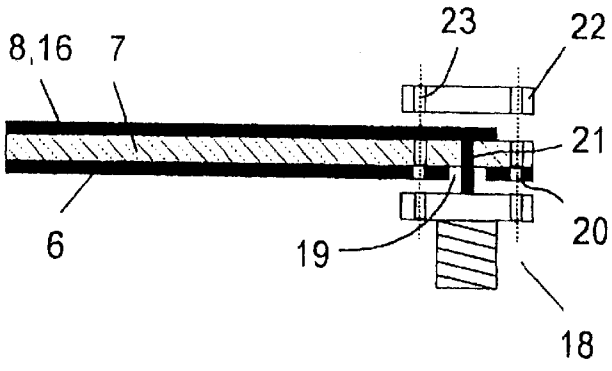
FIG. 5: A cross-sectional illustration of the wave path and the connector.

FIG. 5 shows the cross-sectional view of the extension (24) carrying the wave path (16) and the connector (18). The extension (24) lies between the connector (18) and the pressure block (22). The connector (I 8) and the pressure block (22) are screwed together using the extension (24) and the fixation screws for which the bore holes (23) are provided, so that the connector (18) is firmly connected with the extension (24).

In the following exemplar geometric data are provided the use of which the planar emitter will demonstrate high system quality in the frequency spectrum of from 2.500 GHz to 2.686 GHz.

Figure 6:
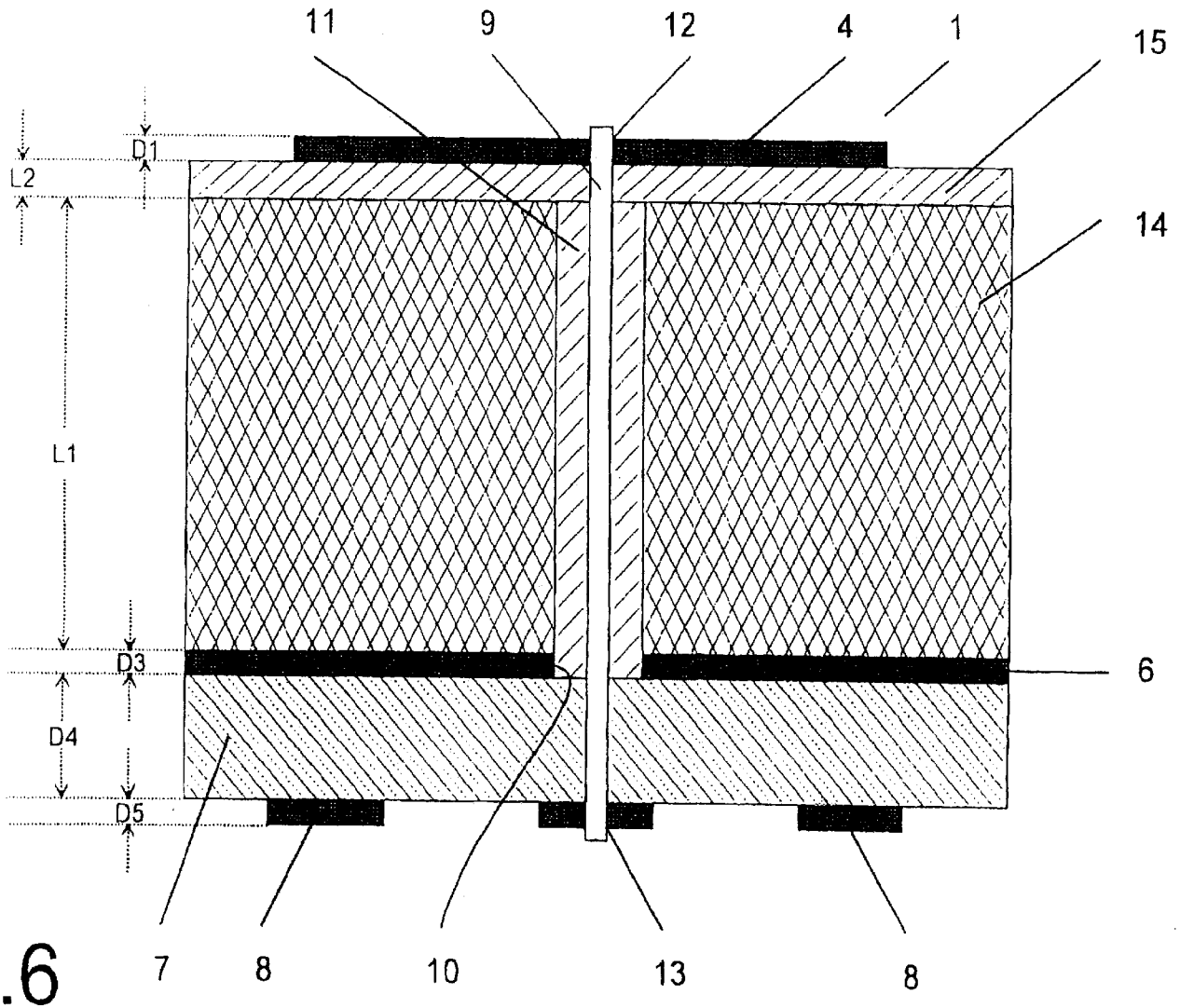
FIG. 6: A cross-sectional illustration of the emitter as described in the invention with two layers forming the first dielectric layer.

The resonator planes (4) have a length of 47 mm, a width of 53 mm and a row and column separation of 87 mm. The feed and coupling point (12) is located within the surface approximately 2 mm from the middle. The thicknesses (D1, D3, and D5) of the copper layers are approximately 18 um thick. The layer (5) is, as illustrated in FIG. 6, two-layered, whereby the first layer (14) has a thickness L1 equal to 10.5 mm and is made of foamed polystyrol whose specific volume weight is 20 kg/$^{m3}$. The second layer (15) has a thickness L2 of 100 um and consists of polyethylenete rephtalate film. The second dielectric layer (7) consists of Fiberglas reinforced polytetraflouroethylene 381 um thick.

All layers are securely joined to one another whereby the layer (14) is glued to layer (15) and the adhesive bond has a thickness of 7 um.

The pin (9) has a diameter of 1.2 mm and lies with one of its ends in the bore hole of layer (7) whose diameter likewise is 1.2 mm and passes through the coupling point (13). The layer (5) and (6) exhibits in the area of the pin (9) similar bore holes whose diameter, for the insertion of the pin (9) and the sheath (11), is 4.2 mm.

The coupling network (3) is constructed symmetrically in such a way that all resonator planes are fed in-phase by the coupling point (17) FIG. 3. The coupling points (13) have an inside diameter of 1.2 mm and an external diameter of 2.1 mm.

Starting from any coupling point (13) FIG. 3 a conductor (3*a*) with a width of 0.49 mm for a length of 27 mm extends in the direction of the feed point (13) adjacent to the cell. This conductor (3*a*) then goes into a conductor (3*b*) having a 1.25 mm width which is 31 mm long. Then the conductor (3*b*) continues into a width of 0.49 mm to reach the neighboring feed point (13) in a length of 27 mm. In this way the feed points of each of the external resonator planes (4) in each cell are connected with the each of the feed points of each of the resonator planes (4) adjacent to and underlying the cell. From the middle of the conductor (3*b*) a conductor (3*c*), having a width of 1.88 mm and a length of 22.3 mm, connects in the cleft in the direction of the conductor (3*b*) and transfers to a width of 1.15 mm for a stretch of 42.45 mm (conductor 3*d*). The conductor expands then again to a width of 1.88 mm, and then after a stretch of 22.3 mm meets up in the middle with the opposite conductor (3*b*). At the middle (17) of the conductor (3*d*), in the direction of the conductor (3*d*) lying opposite, a conductor (3*e*) with a width of 1.88 mm and a length of 22.3 mm. Then the conductor (3*e*) changes over to a width of 1.15 mm for a length of 129.4 mm (conductor 3*f*). The width of the conductor (3*f*) changes to 1.88 mm for a length of 22.3 mm. Thus the middle of the conductor (3*d*) lying opposite is reached. At the middle of the conductor (3*f*) a wave guide with a width of 1.88 mm and a length of 22.3 joins up and thereafter goes to a reduced width of 1.15 mm and goes on to the coupling point (21) of the network (3).

By way of the aforementioned coupling network (3) the inductive reactive components of the pins (9), which are compensated by the measurements of the longitudinal pins (9), which themselves are determined by the thickness of the first dielectric layer (5).

Figure 7:
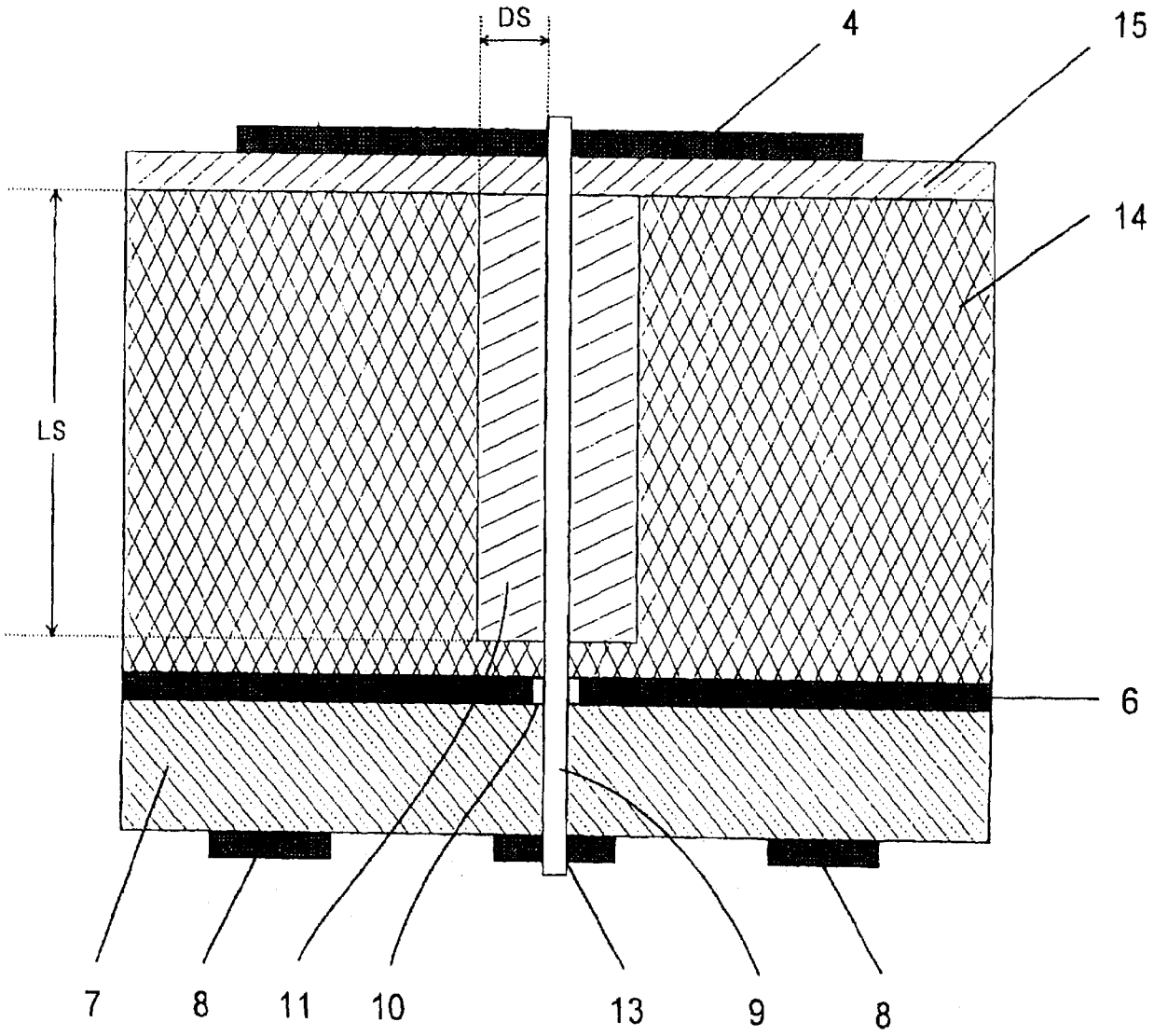
FIG. 7: An illustration in accordance with FIG. 6, whereby the length of the sleeve is shortened and its wall thickness enlarged.

FIG. 7 shows that the sheath (11) does not have to extend over the entire height of the layers (5 and 6). Through the choice of the wall thickness (WS) and the length (LS) of the sheath (11) its capacitative covering can be affected whereby the inductive reactive components of the long pin (9) relieved and the network (3) compensating for the reactive components is no longer required.

Reference Drawing List

1. Emitter Plane
2. Network Plane
3. Coupling Network
3*a*–3*f* Strip Conductor Sectors
4. Planar Resonators
5. First Dielectric Layer
6. Electrically Conducting Thin Layer; Earthing Surface
7. Second Dielectric Layer
8. Microstrip Circuits
9. Connector/Coupling Pin
10. Fenestrated Apertures
11. Sheath
12. Feed Point of the Planar Resonators
13. Coupling Point
14. First Layer
15. Second Layer
16 Wave Path
17 Common Coupling Point
18. Connector; N-Bushing
19. Recess for Pin
20. Recess for Fastening Screw
21. Through Pin
22. Pressure Block
23. Bore Hoe for Fastening Screw

What is claimed is:

1. In a planar emitter apparatus (1) having a plurality of sandwich like layers (4, 5, 6, 7, 8) that are plan-parallel to each other the improvement wherein:

a first layer (5) is a dielectric layer made of two different dielectric materials;

a first dielectric material of said first layer (5) forms a second layer (14) having opposed sides and a thickness L1;

the second dielectric material of said first layer (5) forms a third layer (15) having opposed sides and a thickness L2;

said second layer (14) has one of said opposed sides in contact with one of said opposed sides of said third layer (15);

a fourth layer (7) is a dielectric layer having opposed sides made of a dielectric material;

a fifth layer (6) is an electrically conductive thin layer defining a common earthing member for said planar emitter apparatus (1) and interposed between and in contact with the side of said second layer (14) that is not in contact with said third layer (15) and with one of said sides of said fourth layer (7);

a sixth layer (4) is a plurality of spaced, thin layer electrically conductive planar resonators (4) in contact with the side of said third layer (15) that is not in contact with said second layer (14);

a seventh layer (8) is a coupling network (3) comprising microstrip circuits (3*a*–3*f*) in contact with the side of said fourth layer (7) that is not in contact with said sixth layer (6);

means (9) extend through said first, fifth and fourth layers (5, 6, 7) from said coupling network (3) to said planar resonators (4) to couple said planar resonators (4) electrically in phase; and said thickness L1 of said second layer (14) is greater than said thickness L2 of said third layer (15).

2. The planar emitter apparatus (1) of claim 1 wherein:

said thickness L1 of said second layer (14) is at least 10 times greater than said thickness L2 of said third layer 15.

3. The planar emitter apparatus (1) of claim 2 wherein:

said material of said third layer (15) has temperature and heat resistant qualities that protect the material from melting during standard electrical soldering procedures; and said material of said second layer (14) is a relatively low cost material when compared to the cost of said material of said third layer (15).

4. The planar emitter apparatus (1) of claim 1 wherein:

said dielectric material of said second layer (14) is polysterol in a flexible foam form having a specific weight volume of 20 kg/m$^3$; and, said dielectric material of said third layer (15) is a polyethylene terephtalate film.

5. The planar emitter apparatus (1) of claim 4 wherein:

said thickness L1 is 10.5 mm; and said thickness L2 is 100 $\mu$m.

6. The planar emitter apparatus (1) of claim 5 wherein said second layer (14) is glued to said third layer (15).

7. The planar emitter apparatus (1) of claim 6 wherein the electrically conducting thin fifth layer (6) has a thickness of approximately 18 $\mu$m.

8. The planar emitter apparatus (1) of claim 1 wherein each planar resonator (4) is in electrical conducive connection with the coupling network (3) by means of an electrically conductive connector pin (9), whereby the electrically conductive connector pins (9) lie in a passage bore hole perpendicular to said first, fifth and fourth layers (5, 6, 7).

9. The planar emitter apparatus (1) of claim 8 wherein the electrically conductive thin fifth layer (6) has particular circular apertures (10) for pins (9) of a size such that the pins (9) are not in electrical connection with the electrically conductive thin fifth layer (6).

10. The planar emitter apparatus (1) of claim 9 wherein the circular apertures (10) form orifices, and that by means of the diameters of the orifices (10) the reflection and transmission factor between the coupling network and the respective planar resonators is adjustable.

11. The planar emitter apparatus (1) of claim 10 wherein each electrically conductive pin (9), is in the area between the conductive layer of the planar resonators (4) and the conductive layer of the microstrip circuits (3*a*–3*f*) and is enclosed by a sheath (11).

12. The planar emitter apparatus (1) of claim 11 wherein said sheath (11) is made of a dielectric material whose dielectrical constant $\in_r$ is greater that the dielectrical constant $\in_r$ of the material of the dielectric first and fourth layers (5, 7) surrounding the sheath (11).

13. The planar emitter apparatus (1) of claim 12 wherein the appropriate choice of wall thickness WS, height LS, and the dielectrical constant $\in_r$ of the sheath (11) can compensate the inductive reactive component of the thickness L1, L2 of said first dielectric layer (5).

14. The planar emitter apparatus (1) of claim 13 wherein the height LS of the sheath (11) maintains the distance between the planar resonator (4) and the coupling network (3), at least in the areas of the pins (9), even under the effects of external forces.

15. The planar emitter apparatus (1) of claim 14 wherein by means of the coupling network (3) the inductive reaction components of the pin (9) and the capacitative covering of sheath (11) resulting from the thickness L1, L2 of said first dielectric layer (5) is compensatable.

16. The planar emitter apparatus (1) of claim 15 wherein the planar resonators (4) are square and matrix-like and arranged in two rows and four columns.

17. The planar emitter apparatus (1) of claim 16 wherein the row and column separation of the planar resonators (4), arranged in matrix-like form, are uniform.

18. The planar emitter apparatus (1) of claim 1 wherein said seventh layer (8), said fourth dielectric layer (7) and said fifth layer (6), is extended in the form of a wave path (16) between a common coupling point (17) on said seventh layer (8) and a connector (18) to define a waveguide side coupling directly to the connector (18) coaxially without separation from a waveguide plane.

* * * * *